US005527051A

United States Patent [19]

Plaza

[11] Patent Number: 5,527,051

[45] Date of Patent: Jun. 18, 1996

[54] MECHANIC'S CREEPER

[75] Inventor: Wilfredo Plaza, Camden, N.J.

[73] Assignee: P & B Manufacturing Co., Deptford, N.J.

[21] Appl. No.: 383,453

[22] Filed: Feb. 3, 1995

[51] Int. Cl.[6] ..... B25H 5/00

[52] U.S. Cl. ..... 280/32.6; 16/35 R

[58] Field of Search ..... 180/32.6; 16/35 R, 16/44

[56] References Cited

U.S. PATENT DOCUMENTS

| | | | |
|---|---|---|---|
| 4,543,685 | 10/1985 | Kassai | 16/35 R |
| 4,792,147 | 12/1988 | Wissing | 280/32.6 |
| 5,174,592 | 12/1992 | Pool | 280/32.6 |

*Primary Examiner*—Mitchell J. Hill

*Attorney, Agent, or Firm*—Norman E. Lehrer; Jeffrey S. Ginsberg

[57] ABSTRACT

A creeper includes a torso supporting platform with a number of bores formed vertically therethrough. Each of the bores has a polygonal recess formed around the bottom thereof. A caster extends downwardly from each of the bores. Each caster includes a caster wheel, a bracket secured thereto and extending upwardly therefrom and a shaft extending upwardly from the bracket. Each of the shafts is positioned in a different one of the bores and is axially aligned with the same. A polygonal nut is secured around each of the shafts and is positioned atop a corresponding bracket. Each of the polygonal nuts is sized to be inserted in a corresponding one of the polygonal recesses. A hollowed cap with an internal thread is inserted into the top of the bore and over the shaft in order to secure the shaft to the platform.

4 Claims, 2 Drawing Sheets

MECHANIC'S CREEPER

BACKGROUND OF THE INVENTION

The present invention relates to creepers for use by mechanics and, more particularly, to such a creeper having a contoured platform for supporting a user and a plurality of detachable casters extending from the bottom thereof.

Creepers are used by virtually every automobile mechanic in order to comfortably maneuver while lying on his back underneath an automobile. Typically, a creeper has a number of casters mounted to its lower surface in order to allow the mechanic to move around under the car and change position.

It is important for the casters to be able to freely rotate underneath the platform to provide the mechanic with the mobility needed to maneuver under a car. A typical caster has a bracket secured through the hub of a wheel and a shaft extending upwardly from the top of the bracket. The shaft is adapted to fit into a cylindrical hole formed in the platform. In most existing creepers, it is often difficult to secure the caster to the bottom of the platform. For example, some creepers may require that the shaft be secured to the platform by threading the former into internal threads that surround the hole formed in the platform. Accordingly, the user has to manually thread the shaft up into the platform. This is a relatively time consuming task.

In other creepers, the shaft may be force fitted up into a hole formed in the platform or may be attached utilizing external threads at the top of the shaft and a nut with internal threads so that the later can be threaded to the former. These prior art arrangements, however, can be time consuming to assemble and frequently result in casters that can loosen and become unstable.

SUMMARY OF THE INVENTION

The present invention is designed to overcome the deficiencies of the prior art discussed above. It is an object of the invention to provide a mechanic's creeper having a contoured platform for comfortably supporting a mechanic thereon.

It is a further object of the invention to provide such a creeper that is freely maneuverable under an automobile.

It is yet another object of the invention to provide a creeper that has wheels that can be easily assembled.

In accordance with the illustrative embodiments and demonstrating features of the present invention there is provided a creeper which includes a torso supporting platform with a number of spaced bores formed vertically therethrough. A primary recess is formed around the bottom of each of the bores. A polygonal recess is formed around the bottom of each of the bores and extends further into the platform than the primary recess. A caster extends downwardly from each of the bores in the platform. Each caster includes a wheel with a hub formed therethrough, an axle extending through the hub, a bracket secured to the axle and extending upwardly from the wheel and a spacer rotatably mounted atop the bracket. The spacer is sized to fit into and extend from the primary recess. A threaded shaft extends upwardly from each of the spacers. A polygonal nut is secured around the shaft adjacent the top of the spacer. When the shaft is inserted up into a bore, the polygonal nut fits into the polygonal recess. A hollowed cap with an internal thread is inserted into the top of the bore and over the shaft in order to secure the shaft to the platform.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
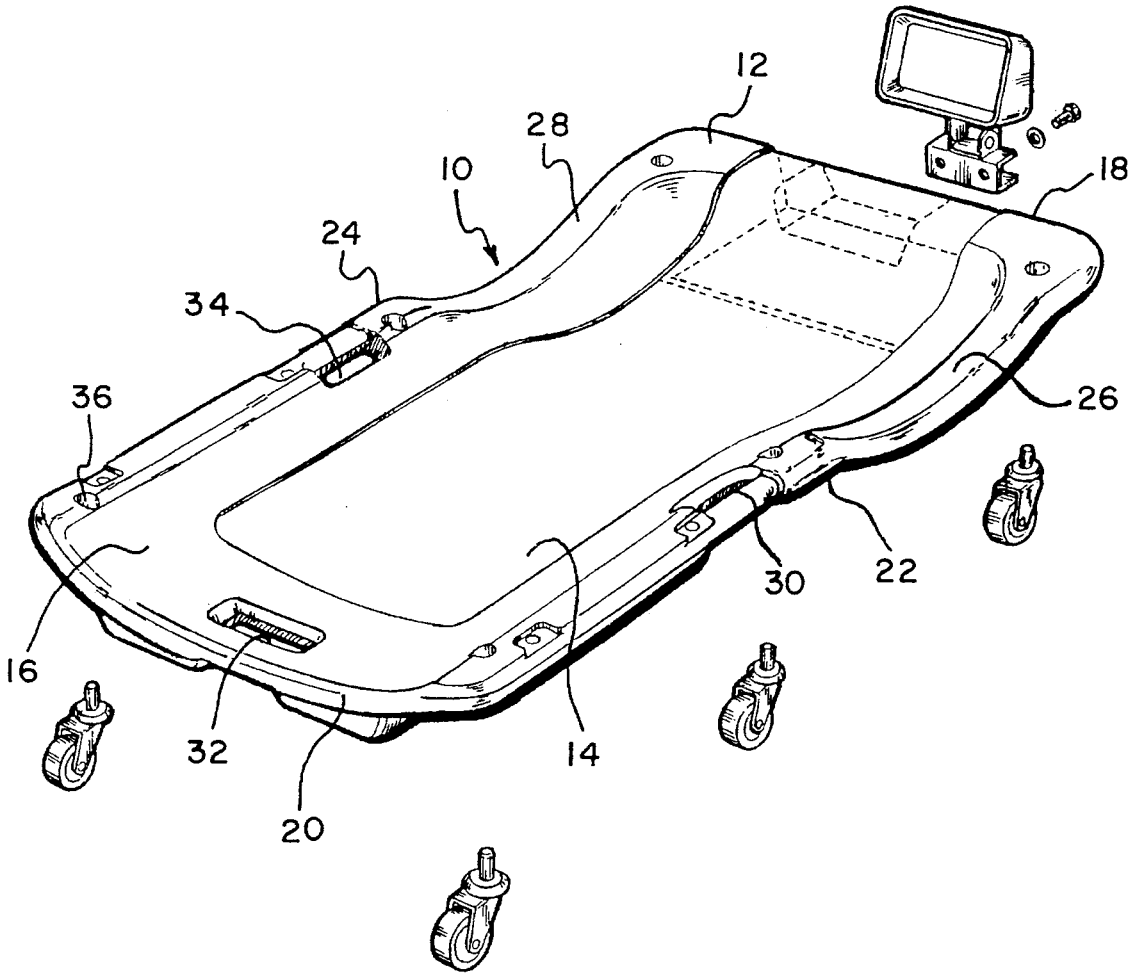
FIG. 1 is an exploded perspective view of a mechanic's creeper constructed in accordance with the principles of the present invention.

Referring now to the drawings in detail wherein like reference numerals have been used throughout the various figures to designate like elements, there is shown in FIG. 1 a mechanic's creeper constructed in accordance with the principles of the present invention and designated generally as 10.

The creeper 10 includes a torso supporting platform 12. The platform is preferably made of molded plastic. However, other suitable material can be used such as fiberglass. The platform 12 has a form-fitting cavity 14 and an upturned periphery 16. The periphery 16 includes front and rear walls 18 and 20, respectively, and side walls 22 and 24. The rear wall 20 is preferably lower than the front wall 18 so that a mechanic's legs can comfortably extend therefrom. The side walls 22 and 24 have depressed areas 26 and 28 in order to comfortably accommodate the arms of a mechanic who is lying on his back in the form fitting cavity 14 of the platform 12. A plurality of slotted openings 30, 32 and 34 are formed in the periphery for accommodating a user's hand in order to facilitate the transportation of the creeper 10. A plurality of spaced apart cylindrical bores 36 are formed vertically through the periphery 16 of the platform 12.

Figure 4:
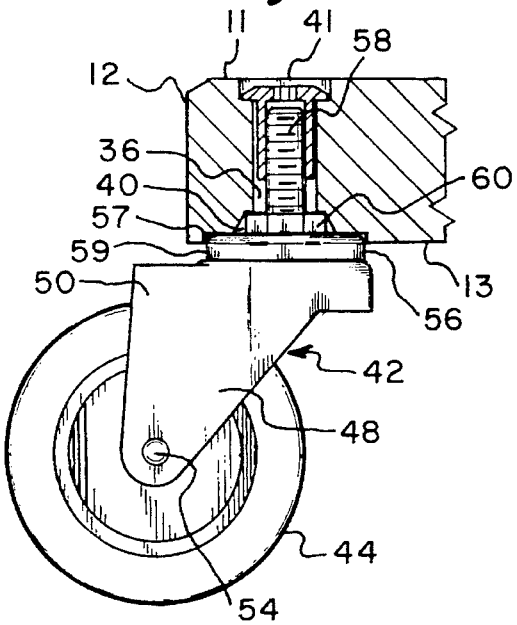
FIG. 4 is a cross-sectional view taken along lines 4—4 of FIG. 2.
Figure 5:
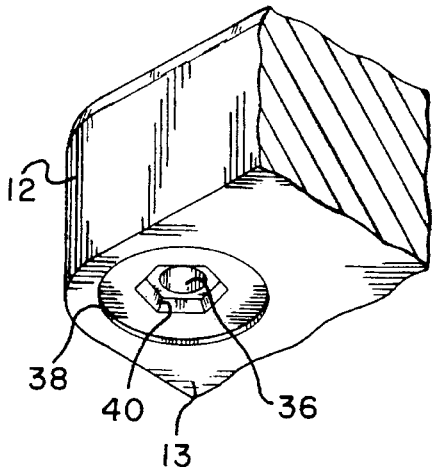
FIG. 5 is a bottom perspective view taken along lines 5—5 of FIG. 3.

Referring to FIGS. 4 and 5, the platform 12 has a primary recess 38 formed around the bottom of each of the bores 36. A polygonal recess 40 is also formed around the bottom of each of the bores 36. Each of the polygonal recesses 40 extends further into the bottom 13 of the platform 12 than the primary recess 38. The side walls of the polygonal recess 40 diverge toward the bottom 13 of the platform 12. That is, the polygonal recess is wider at the bottom than at the top. A countersunk recess 41 is formed in the top 11 of the platform 12 around the top of each of the bores 36. A caster 42 is secured in each of the bores 36 in the manner described below.

Figure 2:
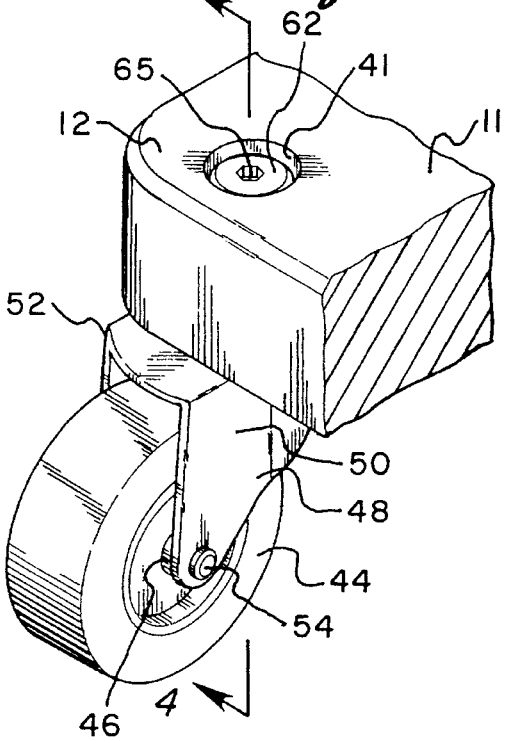
FIG. 2 is a partial perspective view of one corner of the creeper.
Figure 3:
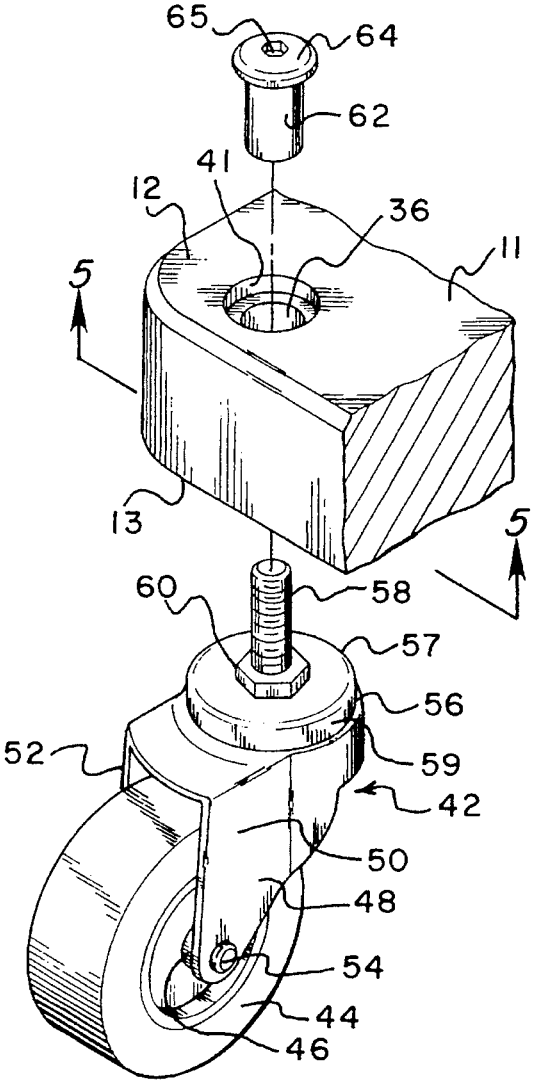
FIG. 3 is an exploded view of FIG. 2.

Referring to FIGS. 2 and 3, the caster 42 includes a wheel 44 having a hub 46 formed therethrough, a bracket 48 having a pair of opposing sides 50 and 52, an axle 54 extending through each of the sides 50 and 52 of the bracket 48 and the hub 46 of the wheel 44, a spacer 56 rotatably mounted atop the bracket 48 and a shaft 58 extending upwardly from the bracket 48 and the spacer 56. The wheel 44 is mounted for rotation on the axle 54. The spacer 56 preferably includes a tapered upper portion 57 and a lower portion 59. A step in the form of polygonal nut 60 is secured atop the spacer 56 and around shaft 58. The nut 60 is preferably welded to the shaft 58 or to the spacer 56. However, the nut can be secured to the shaft in other ways well known in the art.

The caster 42 is attached to the platform 12 in following manner. The shaft 58 is inserted up into the bore 36 in the platform 12 so that the caster 42 extends from the bottom of the platform as shown in FIG. 4. The polygonal nut 60 is positioned in the polygonal recess 40. Since the sides of the polygonal recess diverge toward the bottom 13 of the platform 12, the insertion of the polygonal nut 60 is facilitated. More specifically, the perimeter of the polygonal recess 40 is significantly larger than the perimeter of the polygonal nut 60 when the nut first enters the recess. Accordingly, the nut does not have to be perfectly aligned with the recess 40 to be inserted therein. Moreover, when the polygonal nut 60 is fully inserted in the polygonal recess 40, the polygonal sides of the recess 40 engage the sides of the polygonal nut 60 to ensure firm engagement between the caster 42 and the platform 12. When the polygonal nut 60 is secured in the polygonal recess 40, the shaft 58, which is welded to the nut 60, is axially aligned with a corresponding cylindrical bore 36. It should be noted that the nut 60 and the recess 40 can be any non-cylindrical shape such as oval rather than polygonal.

The upper portion 57 of the spacer 56 is inserted up into the primary recess 38 as shown in FIG. 4 and the lower portion 59 of the spacer 56 extends from the bottom of the platform 12. Accordingly, a gap is created between the top of the bracket 48 and the bottom 13 of the platform 12. This gap ensures that the bracket 48 and the attached wheel 44 can freely rotate about the spacer.

In the preferred embodiment, the shaft 58 is externally threaded. In order to secure the caster 42 to the platform 12, a hollowed cap 62 is inserted through the top of the bore 36 in the top of the platform 12. The cap 62 includes a flange portion 64. The cap 62 is internally threaded so that it can be threadably secured to the shaft 58 which extends upwardly through the bore 36 from the bottom 13 of the platform 12. The flange 64 of the cap 62 has a cavity 65 formed therein. This cavity is adapted to receive the bit of a power driver that can rapidly thread the cap 62 to the shaft. Since the nut 60 is secured in the polygonal recess 40, the attached shaft 58 does not rotate during the threading of the cap to the shaft. When the cap is threaded to the shaft 58 the flange portion 64 is secured in the countersunk recess 41 formed in the top 11 of the platform 12.

The present invention may be embodied in other specific forms without departing from the spirit or essential attributes thereof and accordingly reference should be made to the appended claims rather than to the foregoing specification as indicating the scope of the invention.

I claim:

1. A creeper comprising:

a torso supporting platform having a top and a bottom, said torso supporting platform further having a bore formed vertically therethrough, said bore having a non-cylindrically shaped recess formed around the bottom thereof;

a caster including a caster wheel, a bracket, a spacer rotatably mounted atop said bracket, a shaft secured to and extending upwardly from said spacer, and a non-cylindrical step, said shaft being positioned in and axially aligned with said bore, said non-cylindrical step being secured around said shaft and positioned atop said spacer, said non-cylindrical step lying within said non-cylindrical recess for preventing rotation of said shaft relative to said platform;

said non-cylindrical recess having downwardly diverging sides for guiding said non-cylindrical step therein.

2. The creeper of claim 1 further including a primary recess formed around said bore in said bottom of said platform and wherein said spacer has a tapered upper portion and a lower portion, said tapered upper portion being positioned in said primary recess.

3. The creeper of claim 1 further including a hollow cap, said hollow cap having an upper portion and a lower portion, said hollow cap further having internal threads for threadably engaging said shaft, said upper portion of said hollow cap being located below said top of said platform when said hollow cap engages said shaft.

4. The creeper of claim 1 further including a plurality of bores substantially the same as said claimed bore and a plurality of casters substantially the same as said claimed caster.

* * * * *